US012760741B2

(12) United States Patent
Kabasawa

(10) Patent No.: US 12,760,741 B2
(45) Date of Patent: Oct. 13, 2026

(54) VACUUM PUMP AND INSULATION MEMBER FOR USE IN VACUUM PUMP

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 0 days.

(21) Appl. No.: 18/700,064

(22) PCT Filed: Nov. 9, 2022

(86) PCT No.: PCT/JP2022/041793

§ 371 (c)(1),
(2) Date: Apr. 10, 2024

(87) PCT Pub. No.: WO2023/090232

PCT Pub. Date: May 25, 2023

(65) Prior Publication Data

US 2024/0337266 A1 Oct. 10, 2024

(30) Foreign Application Priority Data

Nov. 19, 2021 (JP) ..... 2021-188660

(51) Int. Cl.
*F04D 19/04* (2006.01)
*F04D 29/58* (2006.01)

(52) U.S. Cl.
CPC ..... *F04D 19/042* (2013.01); *F04D 19/044* (2013.01); *F04D 29/5853* (2013.01)

(58) Field of Classification Search
CPC .... F04D 19/04; F04D 19/042; F04D 29/5853; F04D 29/522; F04D 29/58; F04D 29/584; F04D 29/586
See application file for complete search history.

(56) References Cited

U.S. PATENT DOCUMENTS 1,946,475 A 2/1934 Barker
4,072,316 A 2/1978 Decker et al.
2001/0019694 A1 9/2001 Blecker et al.
(Continued)

FOREIGN PATENT DOCUMENTS

CN 105952665 A 9/2016
JP H01315693 A 12/1989
(Continued)

OTHER PUBLICATIONS

Translation of JP2002285988, Retrieved Jan. 30, 2026.*
(Continued)

*Primary Examiner* — Courtney D Heinle
*Assistant Examiner* — Cameron A Corday
(74) *Attorney, Agent, or Firm* — Theodore M. Magee; Westman, Champlin & Koehler, P.A.

(57) ABSTRACT

A vacuum pump and a heat insulating member for the vacuum pump are provided that improve the rigidity and heat insulating effect of a heat insulating portion and facilitate the control of intended temperatures of components within the pump. A turbomolecular pump having at least a cooling function includes a heat insulator that is disposed on a threaded spacer and has a hollow structure including cavities extending in the axial direction.

7 Claims, 8 Drawing Sheets

(56) References Cited

U.S. PATENT DOCUMENTS

| | | | | |
|---|---|---|---|---|
| 2003/0095861 | A1* | 5/2003 | Sakaguchi | F04D 29/522 415/90 |
| 2013/0341874 | A1 | 12/2013 | Aykanat et al. | |
| 2017/0183083 | A1 | 6/2017 | Hara et al. | |
| 2019/0242386 | A1 | 8/2019 | Shimizu | |
| 2021/0086264 | A1 | 3/2021 | Bell et al. | |
| 2022/0275809 | A1* | 9/2022 | Kobielski | F02B 37/00 |

FOREIGN PATENT DOCUMENTS

| | | | | | |
|---|---|---|---|---|---|
| JP | H0716968 | A | | 1/1995 | |
| JP | H077922 | U | | 2/1995 | |
| JP | H08140874 | A | | 6/1996 | |
| JP | 2002285988 | A | * | 10/2002 | F04D 19/042 |
| JP | 2015151932 | A | | 8/2015 | |
| JP | 2016176340 | A | | 10/2016 | |
| JP | 2020041503 | A | | 3/2020 | |
| KR | 20120043928 | A | | 5/2012 | |

OTHER PUBLICATIONS

Japanese Notice of Reasons for Refusal for corresponding Japanese application Serial No. 2021-188660, 3 pages.
PCT International Search Report dated Dec. 27, 2022 for corresponding PCT application Serial No. PCT/JP2022/041793, 2 pages.
PCT International Written Opinion dated Dec. 27, 2022 for corresponding PCT application Serial No. PCT/JP2022/041793, 4 pages.
JP Notice of Reasons for Refusal dated May 28, 2025 for corresponding Japanese application Serial No. 2024-141698, 8 pages.
European Communication dated Oct. 1, 2025 and Supplemental Search Report dated Sep. 18, 2025 for corresponding European application Serial No. EP22895514, 10 pages.

* cited by examiner

TIME CHART SHOWING CONTROL PERFORMED WHEN CURRENT COMMAND VALUE IS GREATER THAN DETECTED VALUE

《CURRENT INCREASE CASE》

TIME CHART SHOWING CONTROL PERFORMED WHEN CURRENT COMMAND VALUE IS LESS THAN DETECTED VALUE

《CURRENT DECREASE CASE》

(b) SOLID PLATE

SECOND MOMENT OF AREA (I) = 1/12 x 2.8 x 4^3 = 15.0 $mm^4$ ··· (EXPRESSION 1)

CROSS-SECTIONAL AREA (S) = 2.8 x 4 = 11.2 $mm^2$ ··· (EXPRESSION 2)

(a) HOLLOW PLATE

SECOND MOMENT OF AREA (I) = 1/12 x (2.8 x 5^3 – 2.3 x 4^3) = 16.9 $mm^4$ ··· (EXPRESSION 3)

CROSS-SECTIONAL AREA (S) = 2.8 x 5 – 2.3 x 4 = 4.8 $mm^2$ ··· (EXPRESSION 4)

(c) HOLLOW PLATE

SECOND MOMENT OF AREA (I) = 1/12 x (2.8 x 5^3 – 2.3 x 4^3) = 16.9 $mm^4$ ··· (EXPRESSION 3)

CROSS-SECTIONAL AREA (S) = 2.8 x 5 – 2.3 x 4 = 4.8 $mm^2$ ··· (EXPRESSION 4)

(a)

(b)

(c)

VACUUM PUMP AND INSULATION MEMBER FOR USE IN VACUUM PUMP

CROSS-REFERENCE OF RELATED APPLICATION

This application is a Section 371 National Stage Application of International Application No. PCT/JP2022/041793, filed Nov. 9, 2022, which is incorporated by reference in its entirety and published as WO 2023/090232A1 on May 25, 2023 and which claims priority of Japanese Application No. 2021-188660, filed Nov. 19, 2021.

FIELD

The present invention relates to a vacuum pump and a heat insulating member for the vacuum pump, and more particularly to a vacuum pump that can be used in a pressure range from low vacuum to ultrahigh vacuum and a heat insulating member for the vacuum pump.

BACKGROUND

The manufacturing of semiconductor devices, such as memories and integrated circuits, requires implementation of doping and etching on high-purity semiconductor substrates (wafers) in a state of high-vacuum in a chamber to avoid influences of dust or the like in air. To exhaust the chamber, a vacuum pump, such as a turbomolecular pump, is used.

A known vacuum pump of this type has a cylindrical casing, a cylindrical stator, which is nested in and fixed to the casing and has a thread groove, and a rotor, which is supported in the stator so as to be rotatable at high speed.

With a vacuum pump, depending on the gas drawn through an inlet port of the casing, the gas may undergo a phase change into a solid while undergoing compressing inside the pump (inside the casing) and thus solidify in the pump. As a result, solidified substances may accumulate in the pump, resulting in a problem of a blocked gas passage.

To solve the above problem, a known technique is to heat the vacuum pump in order to increase the temperature and thus prevent the solidification. However, heating the pump without ascertaining the temperature state inside the pump may cause a site, where heat should not be applied, to be heated to a temperature exceeding an appropriate temperature, i.e., to be overheated.

The discussion above is merely provided for general background information and is not intended to be used as an aid in determining the scope of the claimed subject matter. The claimed subject matter is not limited to implementations that solve any or all disadvantages noted in the background.

SUMMARY OF INVENTION

The present invention improves the rigidity and heat insulating effect of a heat insulating portion and facilitates the control of intended temperatures of components within the pump.

To achieve the above objective, the invention provides a vacuum pump having at least one of a heating function and a cooling function and including a heat insulating portion that is disposed on a temperature-controlled component to be heated or cooled and has a hollow structure including cavities extending in an axial direction or a radial direction.

According to this configuration, since the heat insulating portion, which is a part of components, has a hollow structure, the second moment of area of the heat insulating portion is increased, improving the rigidity. Thus, the rigidity and the heat insulating effect are both improved without changing the cross-sectional area of the heat insulating portion, facilitating the control of intended temperatures of components within the vacuum pump. That is, only the necessary components, such as a flow passage on the downstream side, can be selectively heated or cooled.

In a further embodiment, the cavities each have a substantially triangular shape as viewed from a direction of an opening.

According to this configuration, when the hole shape of each cavity is a substantially triangular shape as viewed from the direction of the opening, the rigidity of the heat insulating portion is increased, and the heat insulating portion is easier to form. This reduces the cost and improves the heat insulating effect.

In a further embodiment, the cavities each have a substantially parallelogram shape as viewed from a direction of an opening.

According to this configuration, when the hole shape of each cavity is a substantially parallelogram shape as viewed from the direction of the opening, the rigidity in the radial direction can be selectively reduced. Thus, when a component at the inner side is thermally expanded, the substantially parallelogram-shaped portions may deform to relieve the load.

In a further embodiment, the cavities are at least partially closed.

According to this configuration, when the cavities are at least partially closed, the rigidity is further increased as compared to a configuration in which the cavities are through holes.

In a further embodiment, the pump further includes a turbomolecular pump mechanism including a rotating body having a plurality of rotor blades arranged in multiple stages in the axial direction and a plurality of stator blades disposed between the plurality of rotor blades, wherein the temperature-controlled component is at least one of the plurality of stator blades, and the heat insulating portion is disposed on a support portion of the stator blades.

According to this configuration, in the turbomolecular pump mechanism including a rotating body having a plurality of rotor blades arranged in multiple stages in the axial direction and a plurality of stator blades disposed between the rotor blades, the heat insulating portion having a hollow structure is provided as a spacer on the support portion of the stator blades, thereby increasing the second moment of area of the turbomolecular pump mechanism. As such, the rigidity and the heat insulating effect of the entire pump are both improved, facilitating the control of intended temperatures of components within the vacuum pump. As a result, only the necessary components, such as a flow passage on the downstream side, can be selectively heated or cooled.

In a further embodiment, the pump further comprises a Holweck type pump mechanism including a thread groove provided in at least one of an outer circumference surface of a rotating cylinder and an inner circumference surface of a stator cylinder that face each other in the radial direction, wherein the temperature-controlled component is the stator cylinder, and the heat insulating portion is disposed on a support portion of the stator cylinder.

According to this configuration, in the vacuum pump having the Holweck type pump mechanism including the thread groove provided in at least one of the outer circumference surface of the rotating cylinder and the inner circumference surface of the stator cylinder that face each other in the radial direction, the heat insulating portion having a hollow structure is provided as a spacer on the support portion of the stator cylinder, thereby increasing the second moment of area of the Holweck type pump mechanism. Thus, the rigidity of the entire pump and the heat insulating effect are both improved, facilitating the control of intended temperatures of components within the vacuum pump. As a result, only the necessary components, such as a flow passage on the downstream side, can be selectively heated or cooled.

In a further embodiment, the pump further includes a Siegbahn type pump mechanism including a rotating disc and a stator disc that face each other in the axial direction and a spiral groove provided in at least one surface of the stator disc facing the rotating disc. The spiral groove includes a spiral ridge portion and a spiral root portion. The temperature-controlled component is the stator disc, and the heat insulating portion is disposed on a support portion of the stator disc.

According to this configuration, in the vacuum pump having the Siegbahn type pump mechanism including the rotating disc and the stator disc that face each other in the axial direction and the spiral groove that is provided in at least one surface of the stator disc facing the rotating disc and includes the spiral ridge portion and the spiral root portion, the heat insulating portion having a hollow structure is provided as a spacer on the support portion of the stator disc, thereby increasing the second moment of area of the Siegbahn type pump mechanism. Thus, the rigidity of the entire pump and the heat insulating effect are both improved, facilitating the control of intended temperatures of components within the vacuum pump. As a result, only the necessary components, such as a flow passage on the downstream side, can be selectively heated or cooled.

In a further embodiment, a heat insulating member for a vacuum pump has at least one of a heating function and a cooling function, wherein the heat insulating member is configured to be disposed on a temperature-controlled component to be heated or cooled and has a hollow structure including cavities extending in an axial direction or a radial direction.

According to this configuration, by using the heat insulating member having a hollow structure including cavities extending in the axial direction or the radial direction for a vacuum pump, the second moment of area of the heat insulating portion is increased, thereby increasing the rigidity. Thus, the rigidity of the entire pump and the heat insulating effect are both improved, facilitating the control of intended temperatures of components within the vacuum pump. As a result, only the necessary components, such as a flow passage on the downstream side, can be selectively heated or cooled.

According to the present invention, since the heat insulating portion, which is a part of components, has a hollow structure, the second moment of area of the heat insulating portion is increased, improving the rigidity. Thus, the rigidity and the heat insulating effect are both improved without changing the cross-sectional area of the heat insulating portion, facilitating the control of intended temperatures of components within the vacuum pump. As a result, only the necessary components, such as a flow passage on the downstream side, can be selectively heated or cooled. When heating is required, the portion (area) of the pump that actually requires heating can be heated, preventing the accumulation of reaction products. Conversely, when cooling is required, the portion (area) of the pump that actually requires cooling can be cooled, preventing the heating of the pump.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF DRAWINGS

FIGS. 7A to 7C are diagrams for illustrating the difference in rigidity between a heat insulator of a solid planar structure and heat insulators of hollow planar structures, in which FIG. 7A is a diagram illustrating the rigidity of a solid planar structure, FIG. 7B is a diagram illustrating the rigidity of the hollow planar structure shown in FIG. 5A, and FIG. 7C is a diagram illustrating the rigidity of the hollow planar structure shown in FIG. 6;

DETAILED DESCRIPTION

Figure 1:
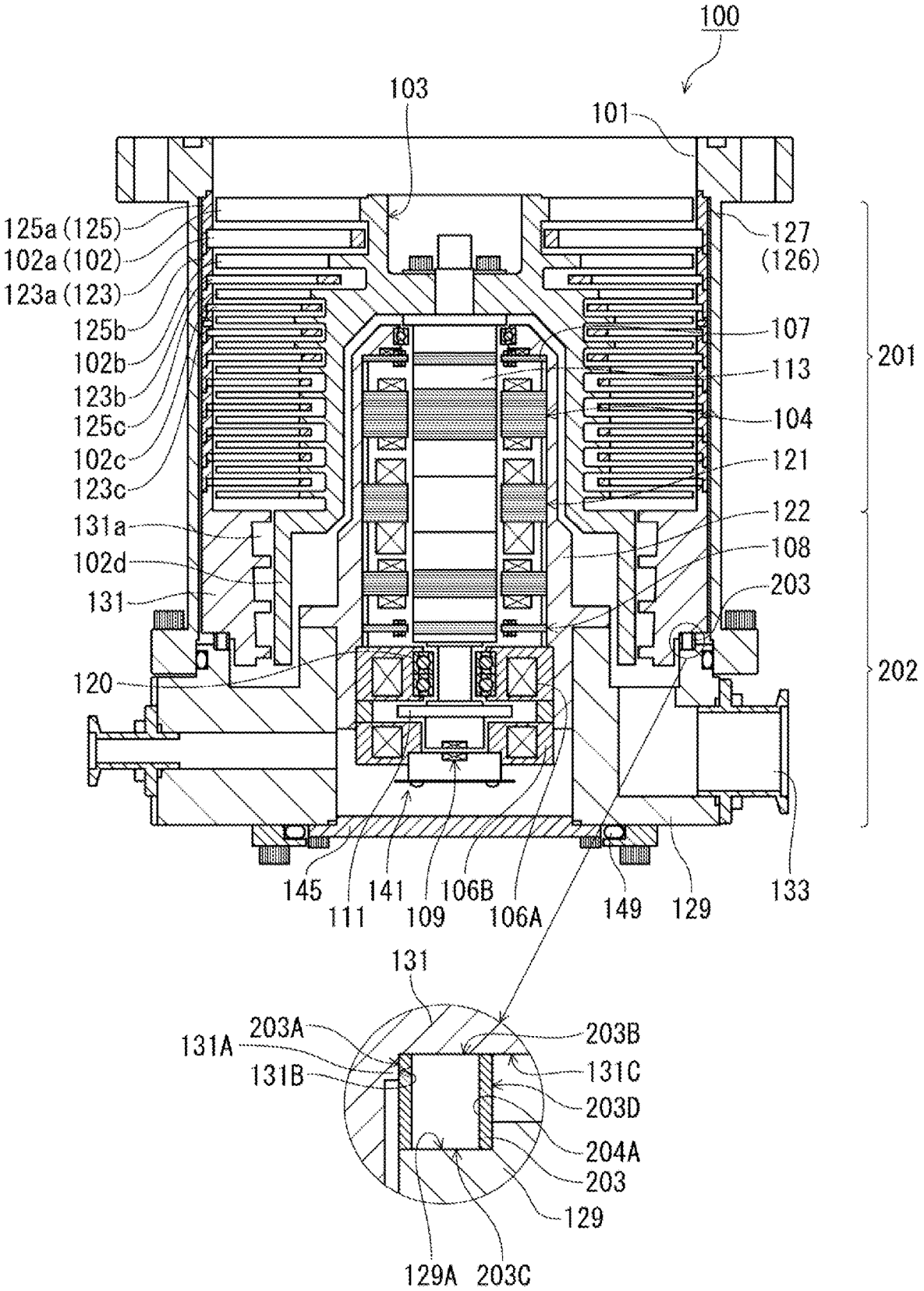
FIG. 1 is a vertical cross-sectional view of a turbomolecular pump as a first example of a vacuum pump according to an embodiment of the present invention.

To achieve the objective of providing a vacuum pump and a heat insulating member for the vacuum pump that improve the rigidity and heat insulating effect of a heat insulating portion and facilitate the control of intended temperatures of components within the pump, the present invention is directed to a vacuum pump having at least one of a heating function or a cooling function and including a heat insulating portion that is disposed on a temperature-controlled component to be heated or cooled and has a hollow structure including cavities extending in an axial direction or a radial direction.

EXAMPLES

Referring to the accompanying drawings, examples according to embodiments of the present invention are described in detail. In the following examples, when reference is made to the number, numerical value, amount, range, or the like of components, it is not limited to the specific number, and may be greater than or less than the specific number, unless specified otherwise or clearly limited to the specific number in principle.

Also, when reference is made to the shape and positional relationship of components and the like, those that are substantially analogous or similar to the shape and the like are included unless specified otherwise or the content clearly dictates otherwise in principle.

In the drawings, characteristic parts may be enlarged or otherwise exaggerated to improve understanding of the characteristics, and components are not necessarily drawn to scale. In cross-sectional views, hatch patterns of some components may be omitted to improve understanding of the cross-sectional structure of the components.

In the following description, the expressions indicating directions, such as up, down, left, and right, are not absolute and are appropriate when the portions of the vacuum pump of the present invention are in the orientation shown in the drawing, and should be interpreted with a change according to any change in the orientation. Additionally, the same elements are designated by the same reference numerals throughout the description of the examples.

FIG. 1 is a vertical cross-sectional view of a turbomolecular pump 100. As shown in FIG. 1, the turbomolecular pump 100 includes a circular outer cylinder 127, which has an inlet port 101 at its upper end. A rotating body 103 in the outer cylinder 127 includes a plurality of rotor blades 102 (102*a*, 102*b*, 102*c*, . . . ), which are turbine blades for gas suction and exhaustion, in its outer circumference section. The rotor blades 102 extend radially in multiple stages. The rotating body 103 has a rotor shaft 113 in its center. The rotor shaft 113 is suspended in the air and position-controlled by a magnetic bearing of 5-axis control, for example.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects the position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to the controller (not shown).

In the controller, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) shown in FIG. 2 controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the controller.

In the controller, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the controller appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the controller so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The controller detects the position of the magnetic poles using both detection signals of the phase sensor and the rotational speed sensor.

A plurality of stator blades 123*a*, 123*b*, 123*c*, . . . are arranged slightly spaced apart from the rotor blades 102 (102*a*, 102*b*, 102*c*, . . . ). Each rotor blade 102 (102*a*, 102*b*, 102*c*, . . . ) is inclined by a predetermined angle from a plane perpendicular to the axis of the rotor shaft 113 in order to transfer exhaust gas molecules downward through collision.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 is fixed to the outer circumferences of the stator blade spacers 125 with a slight gap. A base portion 129 is located at the base of the outer cylinder 127. The base portion 129 has an outlet port 133 providing communication to the outside. The exhaust gas transferred to the base portion 129 through the inlet port 101 from the chamber is then sent to the outlet port 133.

According to the application of the turbomolecular pump 100, a threaded spacer 131 may be provided between the lower part of the stator blade spacer 125 and the base portion 129. The threaded spacer 131 is a cylindrical member made of a metal such as aluminum, copper, stainless steel, or iron, or an alloy containing these metals as components. The threaded spacer 131 has a plurality of helical thread grooves 131*a* in its inner circumference surface. When exhaust gas molecules move in the rotation direction of the rotating body 103, these molecules are transferred toward the outlet port 133 in the direction of the helix of the thread grooves 131*a*. In the lowermost section of the rotating body 103 below the rotor blades 102 (102*a*, 102*b*, 102*c*, . . . ), a cylindrical portion 102*d* extends downward. The outer circumference surface of the cylindrical portion 102*d* is cylindrical and projects toward the inner circumference surface of the threaded spacer 131. The outer circumference surface is adjacent to but separated from the inner circumference surface of the threaded spacer 131 by a predetermined gap. The exhaust gas transferred to the thread grooves 131*a* by the rotor blades 102 and the stator blades 123 is guided by the thread grooves 131*a* to the base portion 129.

The base portion 129 is a disc-shaped member forming the base section of the turbomolecular pump 100, and is generally made of a metal such as iron, aluminum, or stainless steel. The base portion 129 physically holds the turbomolecular pump 100 and also serves as a heat conduction path. As such, the base portion 129 is preferably made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the chamber through the inlet port 101. The exhaust gas taken through the inlet port 101 moves between the rotor blades 102 and the stator blades 123 and is transferred to the base portion 129. At this time, factors such as the friction heat generated when the exhaust gas comes into contact with the rotor blades 102 and the conduction of heat generated by the motor 121 increase the temperature of the rotor blades 102. This heat is conducted to the stator blades 123 through radiation or conduction via gas molecules of the exhaust gas, for example.

The stator blade spacers 125 are joined to each other at the outer circumference portion and conduct the heat received by the stator blades 123 from the rotor blades 102, the friction heat generated when the exhaust gas comes into contact with the stator blades 123, and the like to the outside.

In the above description, the threaded spacer 131 is provided at the outer circumference of the cylindrical portion 102*d* of the rotating body 103, and the thread grooves 131*a* are engraved in the inner circumference surface of the threaded spacer 131. However, this may be inversed in some cases, and a thread groove may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 may be maintained at a predetermined pressure by purge gas.

In this case, the base portion 129 has a pipe (not shown) through which the purge gas is introduced. The introduced purge gas is sent to the outlet port 133 through gaps between a protective bearing 120 and the rotor shaft 113, between the rotor and the stator of the motor 121, and between the stator column 122 and the inner circumference cylindrical portion of the rotor blade 102.

The turbomolecular pump 100 requires the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the turbomolecular pump 100, and is closed by an airtight bottom lid 145.

Some process gas introduced into the chamber in the manufacturing process of semiconductors has the property of becoming solid when its pressure becomes higher than a predetermined value or its temperature becomes lower than a predetermined value. In the turbomolecular pump 100A, the pressure of the exhaust gas is lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100.

For example, when SiCl4 is used as the process gas in an Al etching apparatus, according to the vapor pressure curve, a solid product (for example, AlCl3) is deposited at a low vacuum (760 [torr] to 10-2 [torr]) and a low temperature (about 20 [° C.]) and adheres and accumulates on the inner side of the turbomolecular pump 100. When the deposit of the process gas accumulates in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port and the vicinity of the threaded spacer 131.

To solve this problem, conventionally, a heater (not shown) or an annular water-cooled tube 149 is wound around the outer circumference of the base portion 129, and a temperature sensor (e.g., a thermistor, not shown) is embedded in the base portion 129, for example. The signal of this temperature sensor is used to perform control to maintain the temperature of the base portion 129 at a constant high temperature (preset temperature) by heating with the heater or cooling with the water-cooled tube 149 (hereinafter referred to as TMS (temperature management system)), for example.

Figure 2:
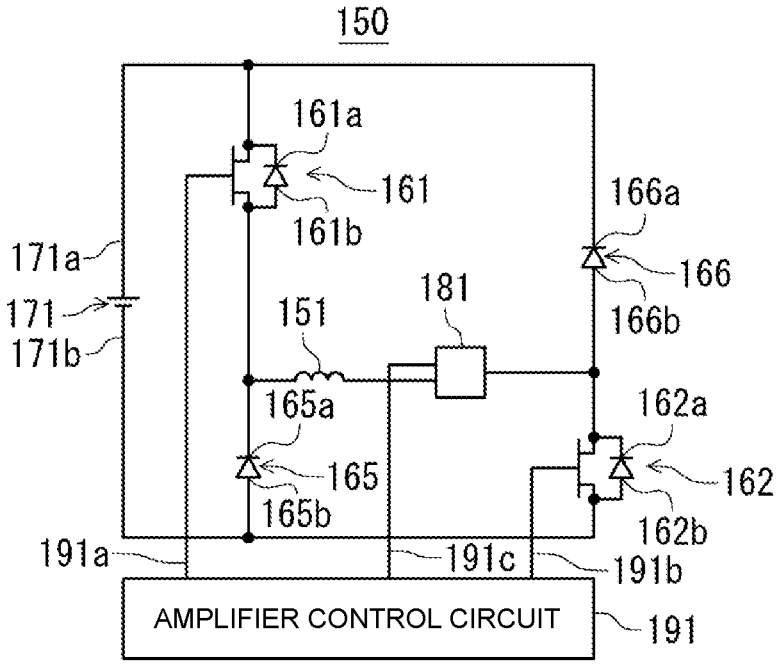
FIG. 2 is a diagram showing an example of an amplifier circuit in the turbomolecular pump of the first example.
Figure 3:
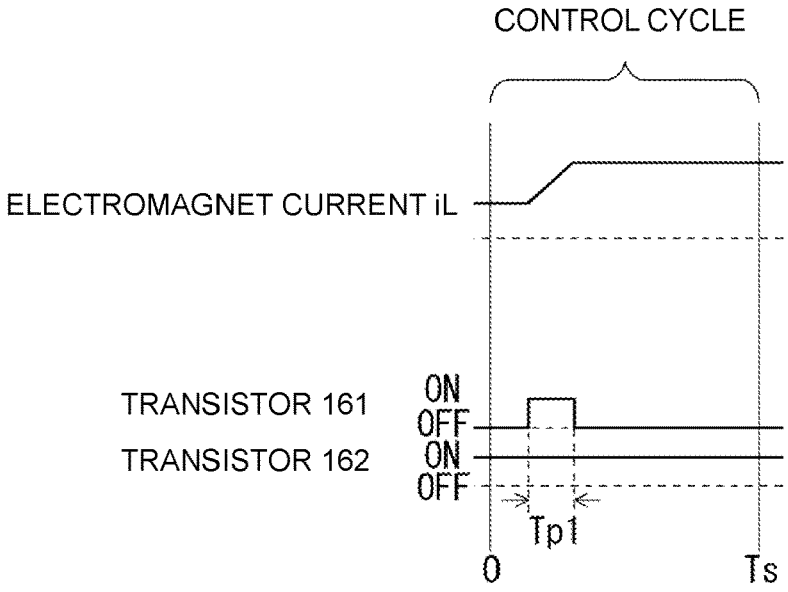
FIG. 3 is a time chart showing an example of control performed when a current command value detected by the amplifier circuit in the turbomolecular pump of the first example is greater than a detected value.
Figure 4:
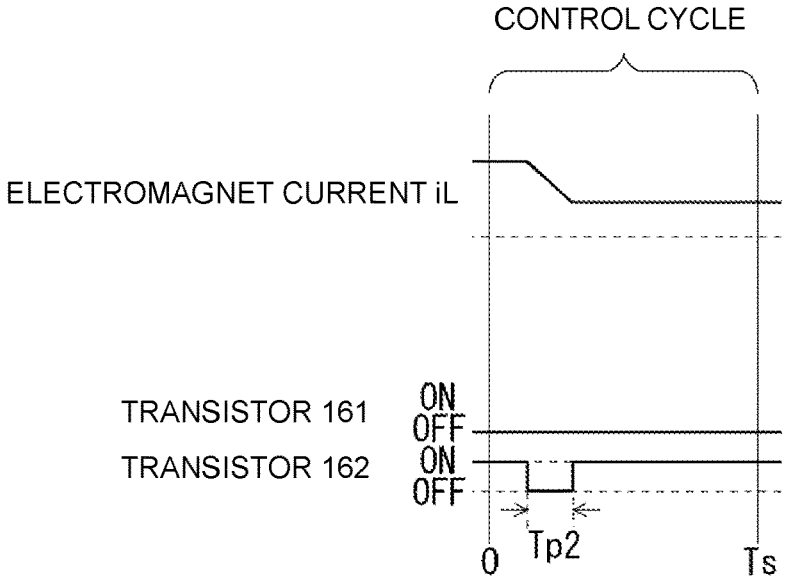
FIG. 4 is a time chart showing an example of control performed when a current command value detected by the amplifier circuit in the turbomolecular pump of the first example is less than a detected value.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit 150.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the controller. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the rotating body 103 reaches a resonance point during acceleration, or when a disturbance occurs during a constant speed operation, the rotating body 103 may require positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 9:
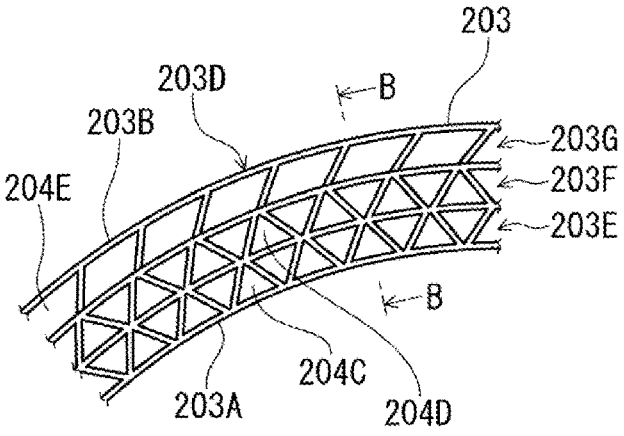
FIG. 9A is a partially enlarged plan view of a heat insulator of a turbomolecular pump according to the second example.
FIG. 9B is a cross-sectional view taken along line B-B in FIG. 9A.
FIG. 9C is a cross-sectional view showing a modification of FIG. 9B.
Figure 9:
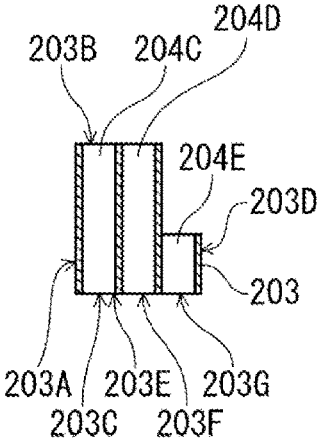
Figure 9:
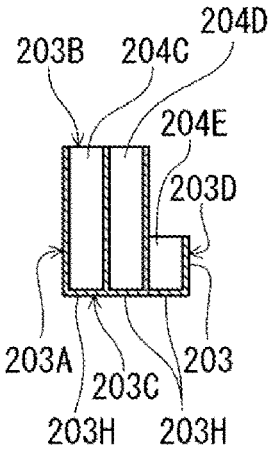

That is, when the detected current value is smaller than the current command value, as shown in FIG. 9, the transistors 161 and 162 are simultaneously on only once in the control cycle Ts (for example, 100 μs) for the time corresponding to the pulse width time Tp1. During this time, the electromagnet current iL increases accordingly toward the current value iLmax (not shown) that can be passed from the positive electrode 171*a* to the negative electrode 171*b* via the transistors 161 and 162.

Figure 10:
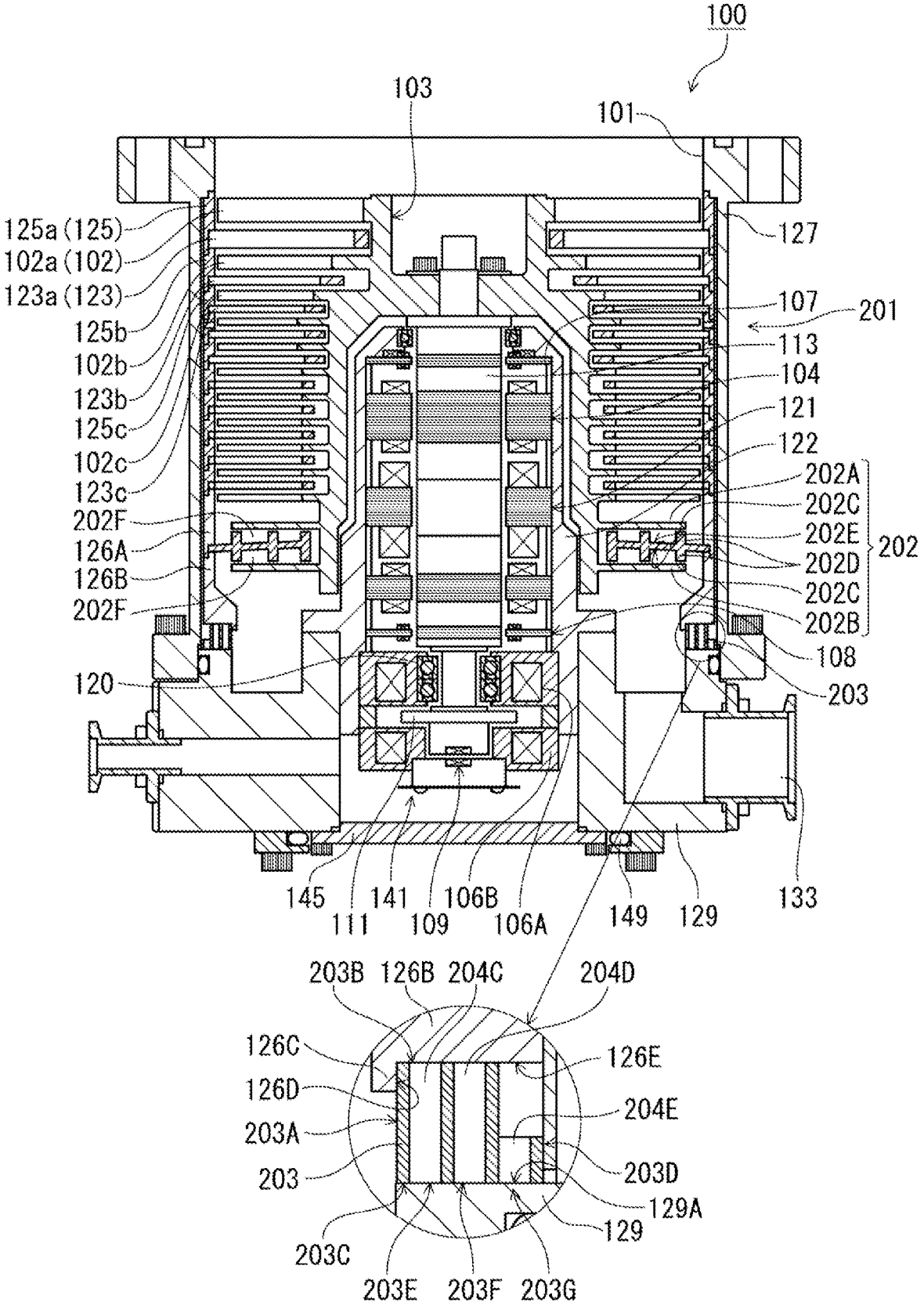
FIG. 10 is a vertical cross-sectional view of a turbomolecular pump as a third example of a vacuum pump according to an embodiment of the present invention.

When the detected current value is larger than the current command value, as shown in FIG. 10, the transistors 161 and 162 are simultaneously off only once in the control cycle Ts for the time corresponding to the pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after the pulse width time Tp1, Tp2 has elapsed, one of the transistors 161 and 162 is on. During this period, the freewheeling current is thus maintained in the amplifier circuit 150.

In the turbomolecular pump 100, the pressure of the exhaust gas is lowest at the inlet port 101 and highest at the outlet port 133 as described above. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100. To solve this problem, at least one of a heating function or a cooling function may be provided by winding a heater (not shown) around the outer circumference of the base portion 129 or by winding an annular water-cooled tube 149 (the present example has a cooling function). Additionally, a temperature sensor (e.g., a thermistor, not shown) is embedded in the base portion 129. The signal of this temperature sensor is used to perform control to maintain the temperature of the base portion 129 at a constant high temperature (preset temperature) by heating with the heater or cooling with the water-cooled tube 149 (TMS).

As such, to limit the effects of the temperature of the turbomolecular pump mechanism 201, which includes the rotating body 103 having a plurality of rotor blades 102 arranged in multiple stages in the axial direction and a plurality of stator blades 123 disposed between the rotor blades 102, and the temperature of the thread groove pump mechanism portion 202 on the temperature control of the base portion 129, and, conversely, to limit the effects of the controlled temperature of the base portion 129 on the turbomolecular pump mechanism 201 and the thread groove pump mechanism portion 202, a heat insulator 203 as a heat insulating portion is provided between the threaded spacer 131 and the base portion 129. The thread groove pump mechanism portion 202 of the turbomolecular pump 100 is configured as a Holweck type pump mechanism having the thread grooves 131*a* in the inner circumference surface of the threaded spacer 131, which is a stator cylinder facing the outer circumference surface of the cylindrical portion 102*d* as a rotating cylinder. However, the thread grooves 131*a* may be provided in the outer circumference surface of the cylindrical portion 102*d* as the rotating cylinder.

The heat insulator 203 functions as a heat insulating portion for blocking the heat transfer between the threaded spacer 131 and the base portion 129. The heat insulator 203 is made of stainless steel and has a lower thermal conductivity than the aluminum threaded spacer 131 and the base portion 129. The specific material of the heat insulator 203 may be any material that has a lower thermal conductivity than either the threaded spacer 131 or the base portion 129, and preferably a material that has a lower thermal conductivity than the aluminum threaded spacer 131 and the base portion 129

As shown in FIG. 1, the heat insulator 203, which is an annular member, is sandwiched between the lower end surface 131C of the threaded spacer 131 and the upper surface 129A of the base portion 129. In this state, an inner circumference surface 203A of the heat insulator 203 faces an outer circumference surface 131B of a lower-end axial support portion 131A of the threaded spacer 131, serving as a support portion of a stator cylinder, an upper end surface 203B of the heat insulator 203 is in contact with a lower end surface 131C of the threaded spacer 131, and a lower end surface 203C of the heat insulator 203 is in contact with an upper surface 129A of the base portion 129.

Figure 5:
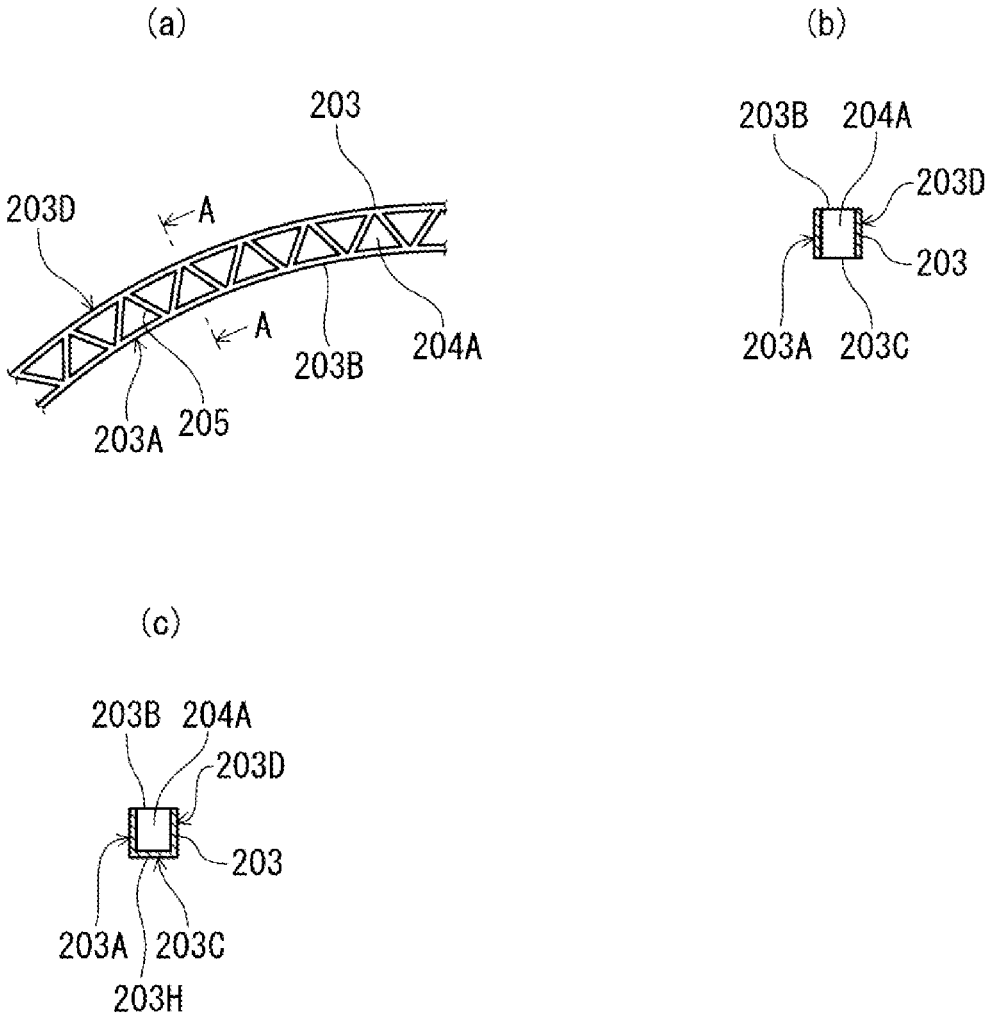
FIG. 5A is a partially enlarged plan view of a heat insulator of a turbomolecular pump according to the first example.
FIG. 5B is a cross-sectional view taken along line A-A in FIG. 5A.
FIG. 5C is a cross-sectional view showing a modification of FIG. 5B.

As shown in FIG. 5, the heat insulator 203 has a repetition of cavities 204A extending through the heat insulator 203 from the upper end surface 203B to the lower end surface 203C between the inner circumference surface 203A and the outer circumference surface 203D, that is, in the thickness portion. Each cavity 204A has a substantially triangular hole shape as viewed from the side corresponding to the end surface 203B (from the direction of the opening). The substantially triangular cavities 204A are regularly arranged with their vertices and bases alternating at the inner side (the inner circumference surface 203A) and the outer side (the outer circumference surface 203D). When the hole shape of each cavity 204A is a substantially triangular shape as viewed from the direction of the opening (direction of the end surface 203B) as described above, the rigidity of the heat insulating portion (heat insulator 203) is increased, and the heat insulating portion is easier to form. This reduces the cost and improves the heat insulating effect. The cavities 204A of the heat insulator 203 described above extend through the heat insulator 203 from the upper end surface 203B to the lower end surface 203C. However, as shown in FIG. 5C, the opening at one end (end at the end surface 203C) of each cavity 204A may be closed so that the cavity 204A has therein a closing portion 203H closing the cavity 204A. This configuration further increases the rigidity of the heat insulator 203 as compared to a configuration in which the cavities 204A are through holes. Even when each cavity 204A has the closing portion 203H, at least one end is hollow, reducing the area of contact. Accordingly, this configuration still reduces the heat conduction of the contact portion and provides a heat insulating effect. The closing portion 203H may close a middle section or both ends of the cavity 204A. Furthermore, only some of the cavities 204A may include closing portions 203H.

Figure 6:
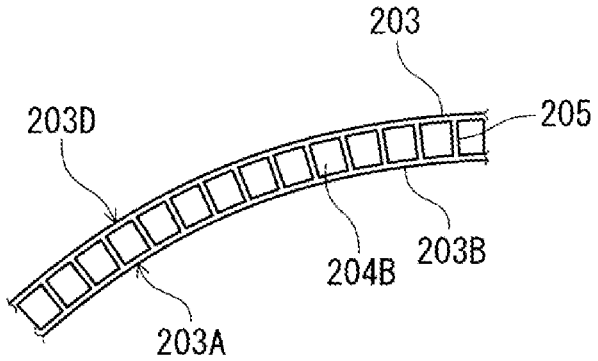
FIG. 6 is a plan view showing another modification of the heat insulator shown in FIG. 5A.

As shown in FIG. 6, the heat insulator 203 may have cavities 204B each having a substantially parallelogram hole shape as viewed from the side corresponding to the end surface 203B (from the direction of the opening) and extending through the heat insulator 203 from the upper end surface 203B to the lower end surface 203C between the inner circumference surface 203A and the outer circumference surface 203D, that is, in the thickness portion. The cavities 204B shown in FIG. 6, each having a substantially parallelogram shape, are regularly arranged with their opposing sides at the inner side (the inner circumference surface 203A) and the outer side (the outer circumference surface 203D). When the hole shape of each cavity 204B is a substantially parallelogram shape as viewed from the direction of the opening (direction of the end surface 203B) as described above, the rigidity of the heat insulating portion (heat insulator 203) is increased, and the heat insulating portion is easier to form. This reduces the cost and improves the heat insulating effect. Furthermore, when the cavity 204B has a substantially parallelogram shape, the rigidity in the radial direction is selectively reduced. Thus, when the temperature-controlled component at the inner side (e.g., the threaded spacer 131, the base portion 129) is thermally expanded, the substantially parallelogram-shaped portions may deform to relieve the load. In the heat insulator 203 shown in FIG. 6, one end, middle section, or both ends of at least some of the cavities 204B may also be closed. This configuration further increases the rigidity of the heat insulator 203 as compared to a configuration in which the cavities 204B are through holes.

Figure 7:
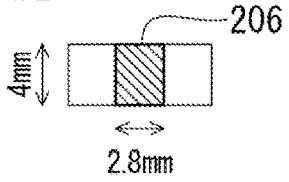
Figure 7:
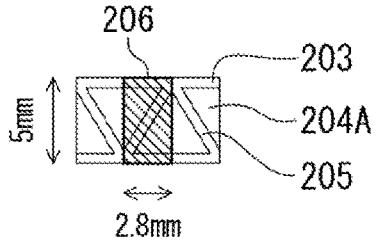
Figure 7:
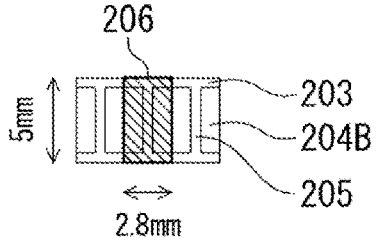

Referring to FIGS. 7A to 7C, the difference in rigidity is now verified between a heat insulator 203 with a hollow structure and heat insulators 203 without a hollow structure. FIG. 7A shows a heat insulator 203 that uses a solid plate without cavities while the other two figures each show a heat insulator that uses a hollow plate with substantially triangular cavities 204A and that uses a hollow plate with parallelogram-shaped cavities 204B. FIG. 7B shows a heat insulator 203 that uses a hollow plate with substantially triangular cavities 204A. FIG. 7C shows a heat insulator 203 that uses a hollow plate with substantially parallelogram-shaped cavities 204B. The verification is performed on a section of a plate thickness T of 4 mm (millimeters) and a circumferential length L (lateral width) of 2.8 mm for the solid plate of FIG. 7A, and a section of a plate thickness T of 5 mm and a circumferential length L (lateral width) of 2.8 mm for each of the hollow plates of FIGS. 7B and 7C. The thickness t of the beams 205 serving as partitions between cavities 204A and 204B of the hollow plates of FIGS. 7B and 7C is 0.5 mm, and the aperture ratio is 66%.

As for the solid plate of FIG. 7A, the second moment of area I of the diagonally shaded section surrounded by the line 206 in FIG. 7A is represented by Expression (1) in FIG. 7A, and the cross-sectional area S is represented by Expression (2).

As for the hollow plate of FIG. 7B, the second moment of area I of the diagonally shaded section surrounded by the line 206 in FIG. 7B is represented by Expression (3) in FIG. 7B, and the cross-sectional area S is represented by Expression (4).

The hollow plate of FIG. 7C is substantially the same as the hollow plate of FIG. 7B, and the second moment of area of the diagonally shaded section surrounded by the line 206 in FIG. 7C is approximately represented by Expression (3), and the cross-sectional area S is represented by Expression (4). Strictly speaking, since the cross-sectional area of the beam portion is larger than that of the hollow plate of FIG. 7B, the second moment of area I is slightly larger. However, approximate calculation is performed assuming that they are equivalent.

The hollow plates of FIGS. 7B and 7C are substantially equivalent to the solid plate of FIG. 7A in second moment of area I, but the cross-sectional areas S of the hollow plates are less than half of the cross-sectional area of the solid plate. As such, the estimate indicates that reducing the length to less than half still results in the equivalent heat insulating effect, a heat insulating effect twice as large as the solid plate can be obtained when the length is the same, and the rigidity is also improved.

Figure 8:
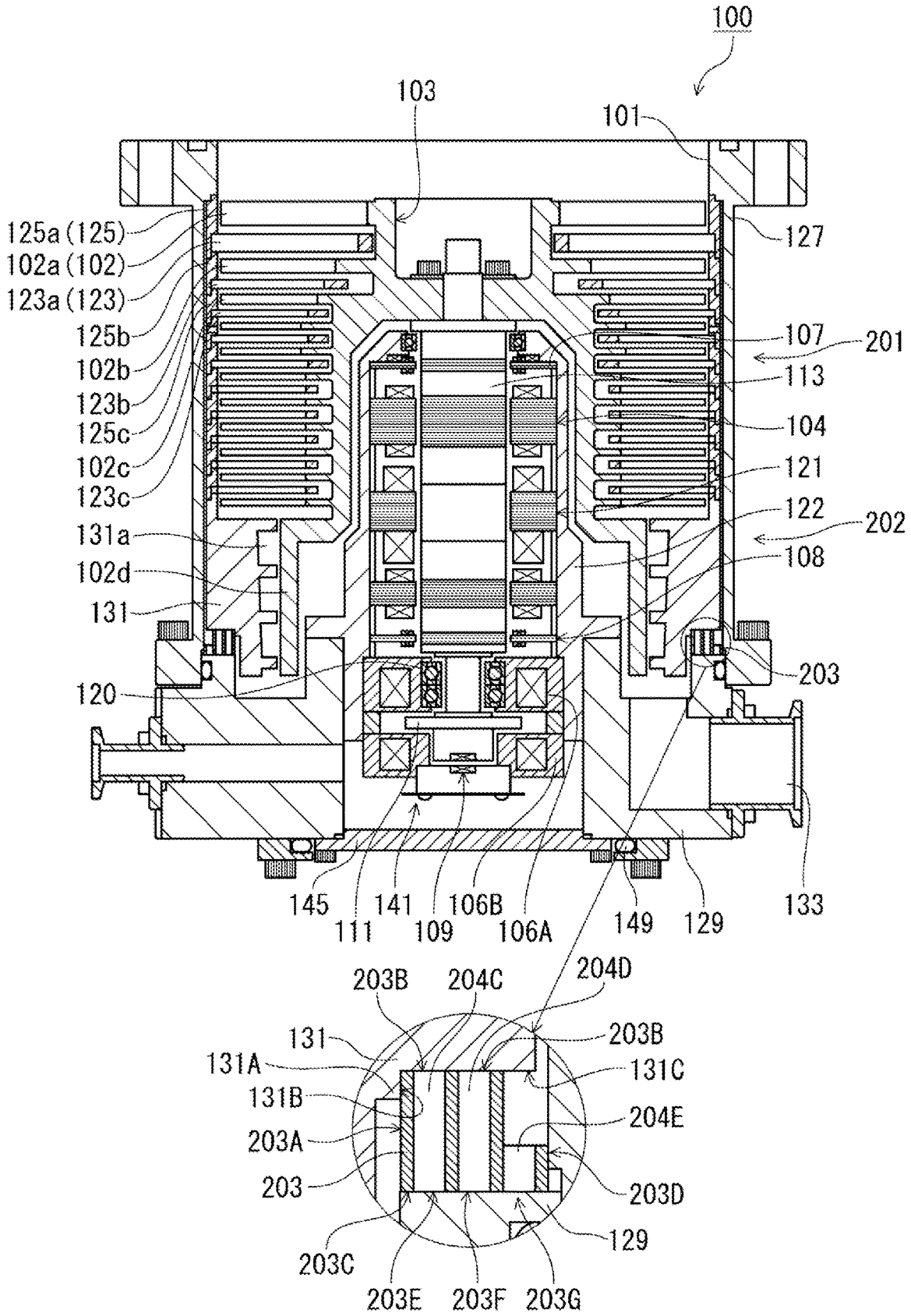
FIG. 8 is a vertical cross-sectional view of a turbomolecular pump as a second example of a vacuum pump according to an embodiment of the present invention.

FIG. 8 shows a second example of a turbomolecular pump 100 according to a vacuum pump of the present invention. The configuration of the second example is a modification of the structure of the heat insulator 203, and the other configurations are the same as those in FIG. 1. Thus, same reference numerals are given to the same components, and the descriptions thereof are omitted.

As in the first example, the turbomolecular pump 100 of the second example is configured as a Holweck type pump mechanism. The thread groove pump mechanism portion 202 has the thread grooves 131*a* in the inner circumference surface of the threaded spacer 131, which is a stator cylinder facing the outer circumference surface of the cylindrical portion 102*d* as a rotating cylinder, in the radial direction. This turbomolecular pump 100 may also be configured such that the thread grooves 131*a* are provided in the outer circumference surface of the cylindrical portion 102*d* as the rotating cylinder.

In the same manner as the first example, to limit the effects of the temperature of the turbomolecular pump mechanism 201 and the temperature of the thread groove pump mechanism portion 202 on the temperature control of the base portion 129, and, conversely, to limit the effects of the controlled temperature of the base portion 129 on the turbomolecular pump mechanism 201 and the thread groove pump mechanism portion 202, the turbomolecular pump 100 of the second example has a heat insulator 203 as a heat insulating portion between the threaded spacer 131 and the base portion 129.

FIG. 9A is a partially enlarged plan view of the heat insulator 203 of the turbomolecular pump 100 according to the second example. FIG. 9B is a cross-sectional view taken along line B-B in FIG. 9A.

The heat insulator 203 shown in FIGS. 9A to 9C is also made of stainless steel and has a lower thermal conductivity than the aluminum threaded spacer 131 and the base portion 129. As shown in FIG. 8, the heat insulator 203, which is an annular member, is sandwiched between the lower end surface 131C of the threaded spacer 131 and the upper surface 129A of the base portion 129. In this state, the inner circumference surface 203A of the heat insulator 203 faces the outer circumference surface 131B of the lower-end axial support portion 131A of the threaded spacer 131, serving as a support portion of a stator cylinder, the upper end surface 203B of the heat insulator 203 is in contact with the lower end surface 131C of the threaded spacer 131, and the lower end surface 203C of the heat insulator 203 is in contact with the upper surface 129A of the base portion 129.

As shown in FIGS. 9A to 9C, the portion of the heat insulator 203 between the inner circumference surface 203A and the outer circumference surface 203D, that is, the thickness portion, includes three layers of an inner circumference layer 203E, an intermediate layer 203F, and an outer circumference layer 203G, which are arranged in this order from the inner side. The inner circumference layer 203E includes a plurality of cavities 204C connected in the circumferential direction in an annular shape, the intermediate layer 203F includes a plurality of cavities 204D connected in the circumferential direction in an annular shape, and the outer circumference layer 203G includes a plurality of cavities 204E connected in the circumferential direction in an annular shape.

As shown in FIG. 9A, in the inner circumference layer 203E of the heat insulator 203, substantially triangular cavities 204C are regularly arranged in the circumferential direction with their vertices and bases alternating at the inner side (the inner circumference surface 203A) and the outer side (the outer circumference surface 203D). In the intermediate layer 203F, substantially triangular cavities 204D are also regularly arranged with their vertices and bases alternating at the inner side (the inner circumference surface 203A) and the outer side (the outer circumference surface 203D). The bases of the substantially triangular cavities 204D of the intermediate layer 203F are adjacent to the bases of the substantially triangular cavities 204C of the inner circumference layer 203E. In the outer circumference layer 203G, cavities 204E each having a substantially parallelogram shape as viewed from the direction of the opening are regularly arranged in the circumferential direction with one side of each cavity 204E adjacent to the base of a substantially triangular cavity 204D of the intermediate layer 203F. The cavities 204C, 204D, and 204E all extend through the heat insulator 203 from the upper end surface 203B to the lower end surface 203C. Each cavity 204E of the outer circumference layer 203G has a parallelogram shape that is slightly slanted in the circumferential direction, but the cavity 204E may have a substantially parallelogram shape that is not slanted in the circumferential direction as with the cavities 204B of FIG. 6. Also, the height of the outer circumference layer 203G from the lower end surface 203C is slightly less than half the height of the inner circumference layer 203E and the intermediate layer 203F.

The substantially triangular cavities 204C and cavities 204D are formed in the inner circumference layer 203E and the intermediate layer 203F, respectively, and the substantially parallelogram-shaped cavities 204E are formed in the outer circumference layer 203G. This configuration increases the rigidity of the heat insulating portion and also facilitates the formation. Furthermore, the outer circumference layer 203G has the substantially parallelogram-shaped cavities 204E, so that the rigidity in the radial direction is selectively reduced. Thus, when the temperature-controlled component at the inner side (e.g., the threaded spacer 131, the base portion 129) is thermally expanded, the substantially parallelogram-shaped portions may deform to relieve the load.

The cavities 204C and 204D in the inner circumference layer 203E and the intermediate layer 203F of the heat insulator 203 and the cavities 204E in the outer circumference layer 203G described above extend through the heat insulator 203 from the upper end surface 203B to the lower end surface 203C. However, as shown in FIG. 9C, also in the heat insulator 203 of the turbomolecular pump 100 of the second example, at least some of the cavities 204C, 204D, and 204E may each have a closing portion 203H that closes one end (end at the end surface 203C) of the cavity 204C, 204D, 204E. This configuration further increases the rigidity of the heat insulator 203 as compared to a configuration in which the cavities 204C, 204D, and 204E are through holes. Furthermore, the closing portion may close a middle section or both ends of the cavity 204C, 204D, 204E.

FIG. 10 shows a modification of a third example of the turbomolecular pump 100 shown in FIG. 8. This modification has a thread groove pump mechanism portion 202 that is configured as a Siegbahn type pump mechanism. The other configurations are the same as those of the second example. Thus, same reference numerals are given to the same components, and the descriptions thereof are omitted.

The thread groove pump mechanism portion 202 of the turbomolecular pump 100 shown in FIG. 10 includes rotating discs 202A and a stator disc 202B, which faces the rotating discs 202A in the axial direction. A thread groove 202F is formed on each of both surfaces 202C of the stator disc 202B facing the rotating discs 202A. The thread groove 202F is a spiral groove formed by a spiral ridge portion 202D and a spiral root portion 202E.

Both surfaces of the outer circumference portion of the stator disc 202B are sandwiched between a stator blade spacer 126A and a stator blade spacer 126B and fixed to the outer cylinder 127. The rotating discs 202A extend at a substantially right angle from the outer circumference surface of the cylindrical portion 102*d* of the rotating body 103 in the shape of a rotor blade and face the upper and lower surfaces of the stator disc 202B.

The heat insulator 203 is sandwiched between a lower end surface 126E of the stator blade spacer 126B and the upper surface 129A of the base portion 129. In this state, the inner circumference surface 203A of the heat insulator 203 faces an outer circumference surface 126D of a lower-end axial support portion 126C of the stator blade spacer 126B, which is a support portion of the stator disc 202B, the upper end surface 203B of the heat insulator 203 is in contact with the lower end surface 126E of the stator blade spacer 126B, and the lower end surface 203C of the heat insulator 203 is in contact with the upper surface 129A of the base portion 129.

The turbomolecular pump 100 of this modification also has the heat insulator 203 of the three-layered structure shown in FIGS. 8, 9A, and 9B between the stator blade spacer 126B and the base portion 129. Thus, in the same manner as the second example, this modification can limit the effects of the temperature of the turbomolecular pump mechanism 201 and the temperature of the thread groove pump mechanism portion 202 on the temperature control of the base portion 129 and, conversely, the effects of the controlled temperature of the base portion 129 on the turbomolecular pump mechanism 201 and the thread groove pump mechanism portion 202. In the heat insulator 203, the substantially triangular cavities 204C and cavities 204D are formed in the inner circumference layer 203E and the intermediate layer 203F, respectively, and the substantially parallelogram-shaped cavities 204E are formed in the outer circumference layer 203G. This configuration increases the rigidity of the heat insulating portion and also facilitates the formation. Furthermore, the outer circumference layer 203G has the substantially parallelogram-shaped cavities 204E, so that the rigidity in the radial direction is selectively reduced. Thus, when a component at the inner side is thermally expanded, the substantially parallelogram-shaped portions may deform to relieve the load.

In the heat insulating portion (heat insulator 203) of the example described above, the cavities 204C, 204D, and 204E extend in the axial direction, but they may extend in the radial direction.

The invention is amenable to various modifications without departing from the spirit of the invention. The invention is intended to cover all modifications.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum pump having at least one of a heating function and a cooling function, the vacuum pump comprising:

a base forming a base section of the vacuum pump;

a thread groove pump mechanism including a threaded spacer;

a temperature-controlled component including the base or the thread groove pump mechanism a heat insulating portion that is disposed in an axial direction between the thread groove pump mechanism and the base and has a hollow structure including cavities extending in the axial direction or a radial direction, wherein the heat insulating portion includes: an upper end surface which is in contact with a lower end surface of the thread groove pump mechanism; and a lower end surface which is in contact with an upper surface of the base, and the heat insulating portion is sandwiched between the lower end surface of the thread groove pump mechanism and the upper surface of the base, the hollow structure of the heat insulating portion includes a plurality of layers in the radial direction, and in at least one of the plurality of layers, the cavities each have a substantially parallelogram shape as viewed from a direction of an opening.

2. The vacuum pump according to claim 1, wherein the cavities each have a substantially triangular shape as viewed from a direction of an opening.

3. The vacuum pump according to claim 1, wherein the cavities are at least partially closed.

4. The vacuum pump according to claim 1, further comprising a turbomolecular pump mechanism including a rotating body having a plurality of rotor blades arranged in multiple stages in the axial direction and a plurality of stator blades disposed between the plurality of rotor blades, wherein the temperature-controlled component is at least one of the plurality of stator blades, and the heat insulating portion is disposed on a support portion of the stator blades.

5. The vacuum pump according to claim 1, further comprising a Holweck type pump mechanism including a thread groove provided in at least one of an outer circumference surface of a rotating cylinder and an inner circumference surface of a stator cylinder that face each other in the radial direction, wherein the temperature-controlled component is the stator cylinder, and the heat insulating portion is disposed on a support portion of the stator cylinder.

6. The vacuum pump according to claim 1, further comprising a Siegbahn type pump mechanism including a rotating disc and a stator disc that face each other in the axial direction and a spiral groove provided in at least one surface of the stator disc facing the rotating disc, this spiral groove including a spiral ridge portion and a spiral root portion, wherein the temperature-controlled component is the stator disc, and the heat insulating portion is disposed on a support portion of the stator disc.

7. A heat insulating member for a vacuum pump, the vacuum pump having at least one of a heating function and a cooling function, the vacuum pump comprising a base forming a base section of the vacuum pump, a thread groove pump mechanism including a threaded spacer, and a temperature-controlled component including at the base or the thread groove pump mechanism, wherein the heat insulating member is configured to be disposed in an axial direction between the thread groove pump and the base and has a hollow structure including cavities extending in the axial direction or a radial direction, wherein the heat insulating portion includes: an upper end surface which is in contact with a lower end surface of the thread groove pump mechanism; and a lower end surface which is in contact with an upper surface of the base, and the heat insulating portion is sandwiched between the lower end surface of the thread groove pump mechanism and the upper surface of the base, the hollow structure of the heat insulating portion includes a plurality of layers in the radial direction, and in at least one of the plurality of layers, the cavities each have a substantially parallelogram shape as viewed from a direction of an opening.

* * * * *